US006964362B2

(12) United States Patent
Shkolnikov et al.

(10) Patent No.: US 6,964,362 B2
(45) Date of Patent: Nov. 15, 2005

(54) SHOCK-ABSORBING SYSTEM FOR FASTENER DRIVING TOOLS

(75) Inventors: Yury Shkolnikov, Glenview, IL (US); Walter J. Taylor, McHenry, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/774,269

(22) Filed: Feb. 6, 2004

(65) Prior Publication Data

US 2005/0173489 A1 Aug. 11, 2005

(51) Int. Cl.[7] ..... B25C 1/04
(52) U.S. Cl. ..... 227/130; 227/132; 173/210
(58) Field of Search ..... 227/8, 9, 10, 130, 227/132, 134; 173/139, 210

(56) References Cited

U.S. PATENT DOCUMENTS 4,405,071 A * 9/1983 Austin ..... 227/7
4,483,474 A 11/1984 Nikolich
4,721,240 A * 1/1988 Cotta ..... 227/10
4,932,480 A * 6/1990 Golsch ..... 173/210
5,025,971 A 6/1991 Schafer et al.
5,090,606 A * 2/1992 Torii et al. ..... 227/10
5,197,646 A 3/1993 Nikolich
6,138,887 A * 10/2000 Nayrac et al. ..... 227/8

FOREIGN PATENT DOCUMENTS

EP 0 788 863 8/1997
EP 0 805 001 3/2003

* cited by examiner

*Primary Examiner*—Louis K. Huynh
*Assistant Examiner*—Thanh Truong
(74) *Attorney, Agent, or Firm*—Lisa M. Soltis; Mark W. Croll; Lawrence J. Crain

(57) ABSTRACT

A combustion chamber assembly for use in a combustion-powered fastener driving tool, includes a cylinder body, a reciprocating probe assembly slidably disposed relative to the cylinder body between a first, extended position and a second, retracted position, and at least one shock-absorbing member operationally associated with at least one of the cylinder body and the probe assembly for reducing shock load generated by the tool during combustion and transmitted between the probe assembly and the cylinder body. In another embodiment, a single spring disposed between the probe assembly and the cylinder body is configured for biasing the probe assembly into the first position.

17 Claims, 3 Drawing Sheets

SHOCK-ABSORBING SYSTEM FOR FASTENER DRIVING TOOLS

BACKGROUND OF THE INVENTION

The present invention relates to improvements in combustion tools, such as the type used for driving fasteners into work pieces. More specifically, the present invention relates to high-powered combustion tools.

A suitable combustion-powered tool assembly is described in commonly assigned patents to Nikolich U.S. Pat. No. 5,197,646, and U.S. Pat. Nos. 32,452, 4,552,162, 4,483,473, 4,483,474, 4,403,722, and 5,263,439, which are incorporated by reference. Such fastener-driving tools are available commercially from ITW-Paslode (a division of Illinois Tool Works, Inc.) of Vernon Hills, Ill., under its IMPULSE trademark.

Such tools incorporate a generally pistol-shaped tool housing enclosing a small internal combustion engine. The engine is powered by a canister of pressurized fuel gas, also called a fuel cell. A powerful, battery-powered electronic power distribution unit produces the spark for ignition, and a fan located in the combustion chamber provides for both an efficient combustion within the chamber, and facilitates scavenging, including the exhaust of combustion by-products. The engine includes a reciprocating piston with an elongate, rigid driver blade disposed within a cylinder body.

A valve sleeve is axially reciprocable about the cylinder and, through a probe assembly linkage, moves to close the combustion chamber when a work contact element at the end of the probe assembly is pressed against a workpiece. This pressing action also triggers a fuel metering valve to introduce a specified volume of fuel into the closed combustion chamber.

Upon the pulling of a trigger switch, which causes the ignition of a charge of gas in the combustion chamber of the engine, the piston and driver blade are shot downward to impact a positioned fastener and drive it into the workpiece. The piston then returns to its original, or "ready" position through differential gas pressures within the cylinder. Fasteners are fed magazine-style into the nosepiece, where they are held in a properly positioned orientation for receiving the impact of the driver blade.

There is a general interest by designers of such combustion tools to increase combustion efficiency. This has resulted in tools with greater power, generated by a more powerful combustion event in the combustion chamber. One disadvantage of conventional combustion tool assemblies is that, as the tool is operated, significant loads are applied to the workpiece contacting element and transmitted throughout the tool assembly. In particular, as the piston and attached driver blade drive the fastener and reach the bottom of the piston stroke, significant impact forces are generated. These forces are transmitted through the cylinder to the movable valve sleeve, which is connected through a linkage to the workpiece contact element also referred to as the probe assembly. Impact forces are particularly felt at contact points between the cylinder and the valve sleeve/probe assembly. As such, as combustion tools increase in power, the higher loads can lead to breakage of the various parts of the tool, especially the above-discussed contact points between the probe assembly and lower portion of the valve sleeve. Tests have shown that during operation of a typical combustion tool, the piston speed tops about ninety miles per hour is reduced to zero miles per hour at impact. Such repeated impacts have in some cases reduced tool operation life due to premature breakage of components.

Another disadvantage of conventional combustion tool assemblies with higher-powered combustion is that a high driving velocity of the piston can also lead to a higher return velocity of the piston after driving the fastener into the workpiece. The shock from abruptly stopping the piston at the top of the cylinder, as the upper probe assembly contacts the stop tabs on the cylinder or valve sleeve, can cause the piston to bounce back down the cylinder away from the proper firing position. A movement away from the proper firing position can unintentionally increase the volume of the combustion chamber and lead to misfires of the tool.

Still another factor in the use of combustion tools is that there is constantly a need for lighter and smaller tools. Nikolich U.S. Pat. No. 5,197,646, listed above, describes a suitable assembly for shortening the overall length of a combustion-powered tool; however, there is a need for continual improvement in the overall weight of the tool.

Accordingly, there is a need for an improved combustion-powered tool design that reduces the load forces transmitted to the valve sleeve and probe assembly. In addition, there is a need for an improved combustion-powered tool that is less susceptible to a component failure through combustion-generated impact forces.

BRIEF SUMMARY OF THE INVENTION

The above-listed needs are met or exceeded by the present shock-absorbing system for a fastener tool. A main feature of the present system is that the point of contact between the valve sleeve/probe assembly and the cylinder body has been moved away from the conventional location at the lower portion of the cylinder body to an upper part of the cylinder body. Additionally, the system includes a shock-absorbing member for dampening the impact forces and shock transferred from the probe assembly to the cylinder body. The shock-absorbing element is preferably located between upper ends of the arms of the probe assembly and a tab from the cylinder body to reduce the stress on the tool members as the probe assembly returns from the fastener-driving position. It has been found that the current application results in a seven-fold reduction on impact forces generated through combustion. Another feature of the present system is that a pair of valve sleeve return springs used in conventional combustion tools of this type has been replaced by a single spring generally centrally located on an upper probe of the probe assembly.

More specifically, a combustion chamber assembly for use in a combustion-powered fastener driving tool, includes a cylinder body, a reciprocating probe assembly slidably disposed relative to the cylinder body between a first, extended position and a second, retracted position, and at least one shock-absorbing member operationally associated with at least one of the cylinder body and the probe assembly for reducing shock load generated by the tool during combustion and transmitted between the probe assembly and the cylinder body. The probe assembly includes an upper probe including at least one arm portion configured for sliding relationship relative to the cylinder body and having an upper end, the at least one shock-absorbing element disposed between the upper end and a corresponding element of the cylinder body for transmitting loads from the probe assembly to the cylinder body; wherein the at least one shock-absorbing member is configured for reducing load forces generated in a combustion chamber of the assembly upon the probe assembly reaching the second position, and being configured to have sufficient rigidity to limit the travel of the probe assembly relative to the cylinder body and also sufficient resilience for absorbing shock forces generated by the tool in the second position. In another embodiment, a single spring disposed between the probe assembly and the cylinder body is configured for biasing the probe assembly into the first position.

DETAILED DESCRIPTION OF THE INVENTION

Figure 1:
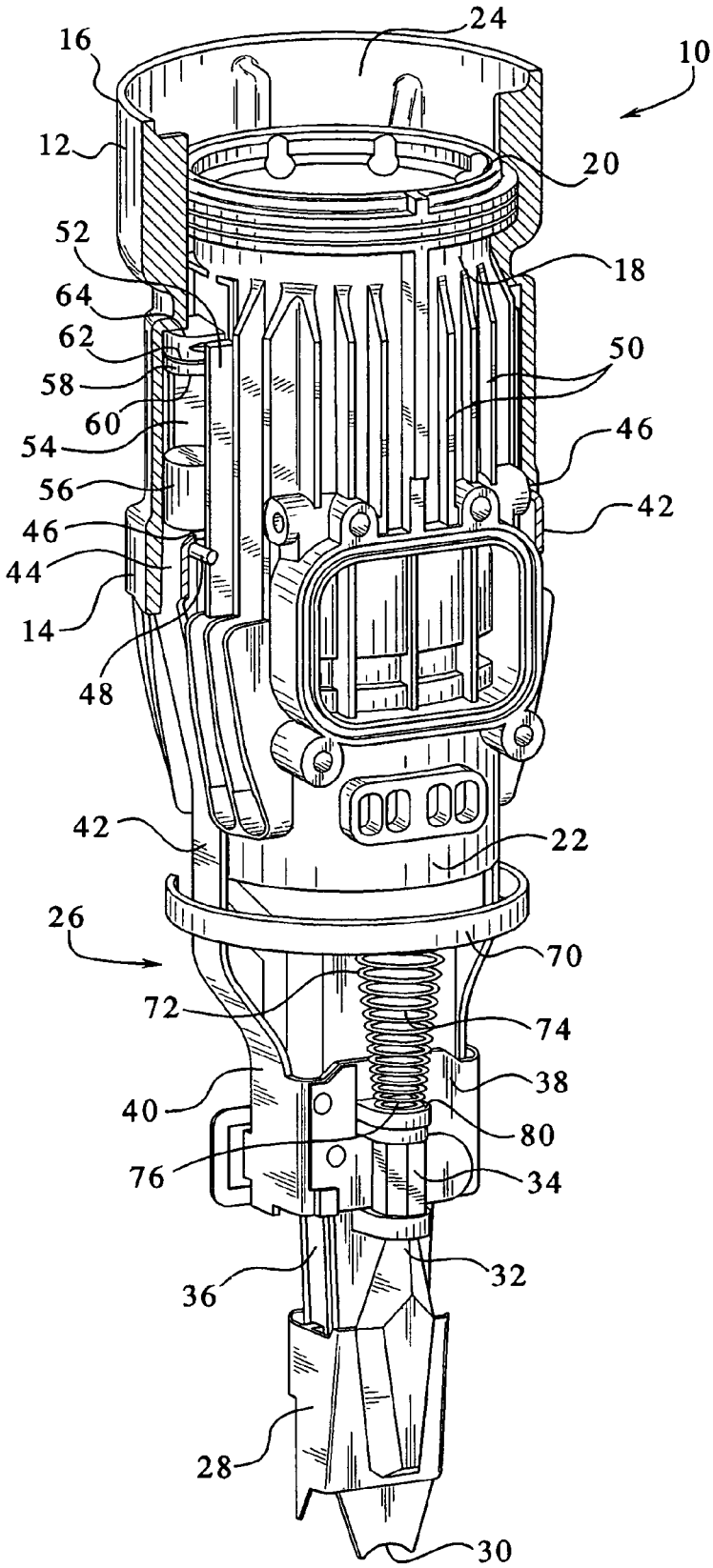
FIG. 1 is a perspective view of a combustion chamber assembly suitable for use with the present shock-absorbing system in a combustion powered tool, with parts omitted for clarity.

Referring now to FIG. 1, a combustion chamber assembly incorporating the features of the present shock-absorbing system is generally designated 10 and is intended for use in a combustion-powered tool, especially the type used for driving fasteners. A combustion-powered tool of the type suitable for incorporating the present system is described in detail in the patents incorporated by reference and referred to above. As is known in the art, the combustion chamber assembly 10 includes a valve sleeve 12 which is preferably generally cylindrical in shape. Included on the valve sleeve 12 are a lower end 14 and an upper end 16. As is known in the combustion-tool art, the valve sleeve 12 is slidably engaged upon a generally cylindrical cylinder body 18. An upper end 20 of the cylinder body 18 generally corresponds to the upper end 16 of the valve sleeve 12, and a lower cylinder body end 22 extends below the lower end 14 of the valve sleeve 12. The cylinder body 18 defines a longitudinal tool axis. In the context of this specification, the terms "upper," "lower" and "vertical" refer to the orientation of the combustion chamber assembly 10 as depicted in FIG. 1, however it is contemplated that the assembly may be operated in varied orientations.

The upper end 16 of the valve sleeve 12 and the upper end 20 of the cylinder body 18 partially define a combustion chamber 24. A piston (not shown) is mounted operatively in the cylinder body 18, and is constructed and arranged for driving a driving blade (not shown) in the longitudinal direction thereby driving a fastener (not shown).

Figure 2:
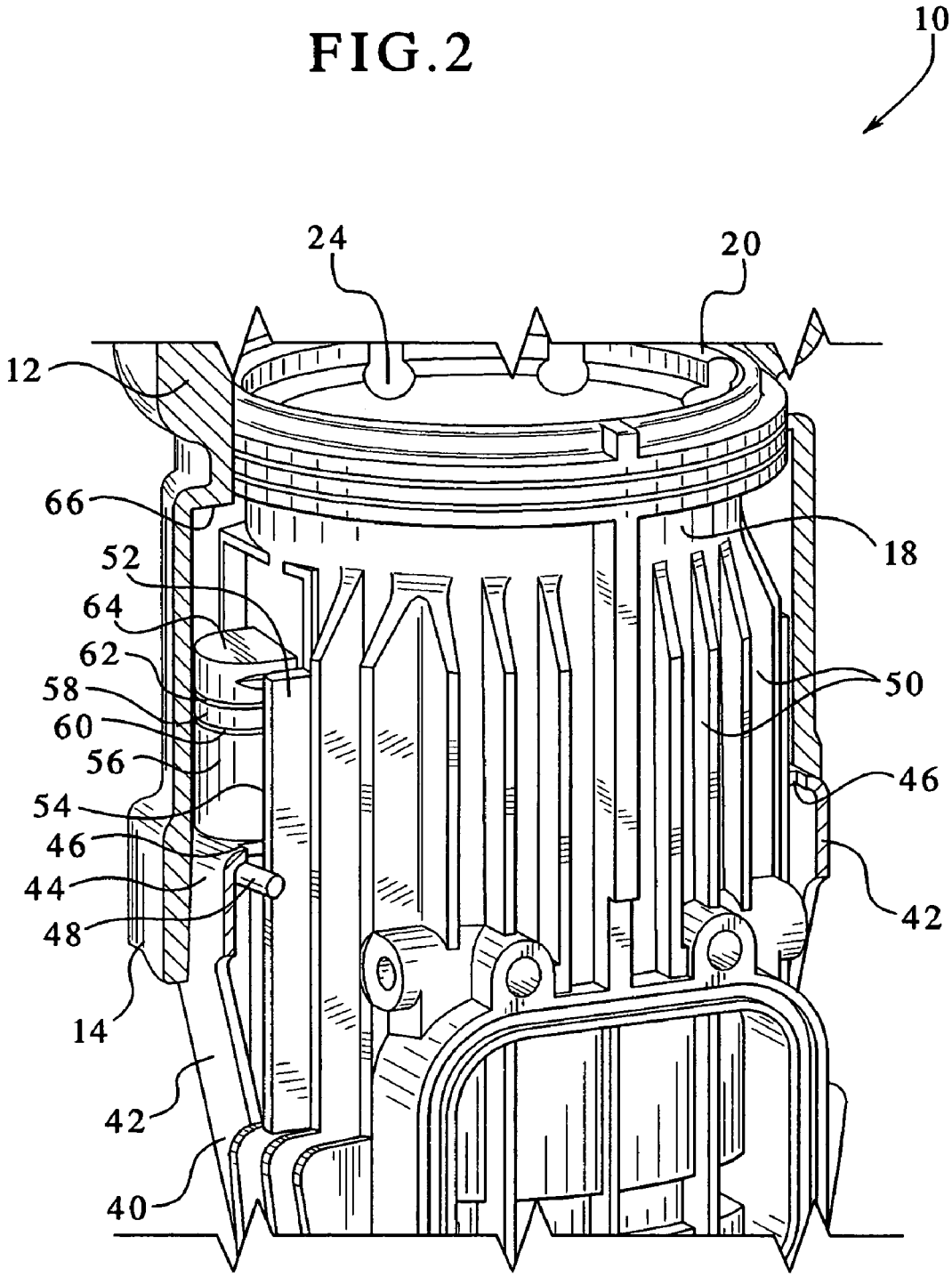
FIG. 2 is a fragmentary perspective view of the present shock-absorbing system with the valve sleeve in the closed position and tool in the rest position.
Figure 3:
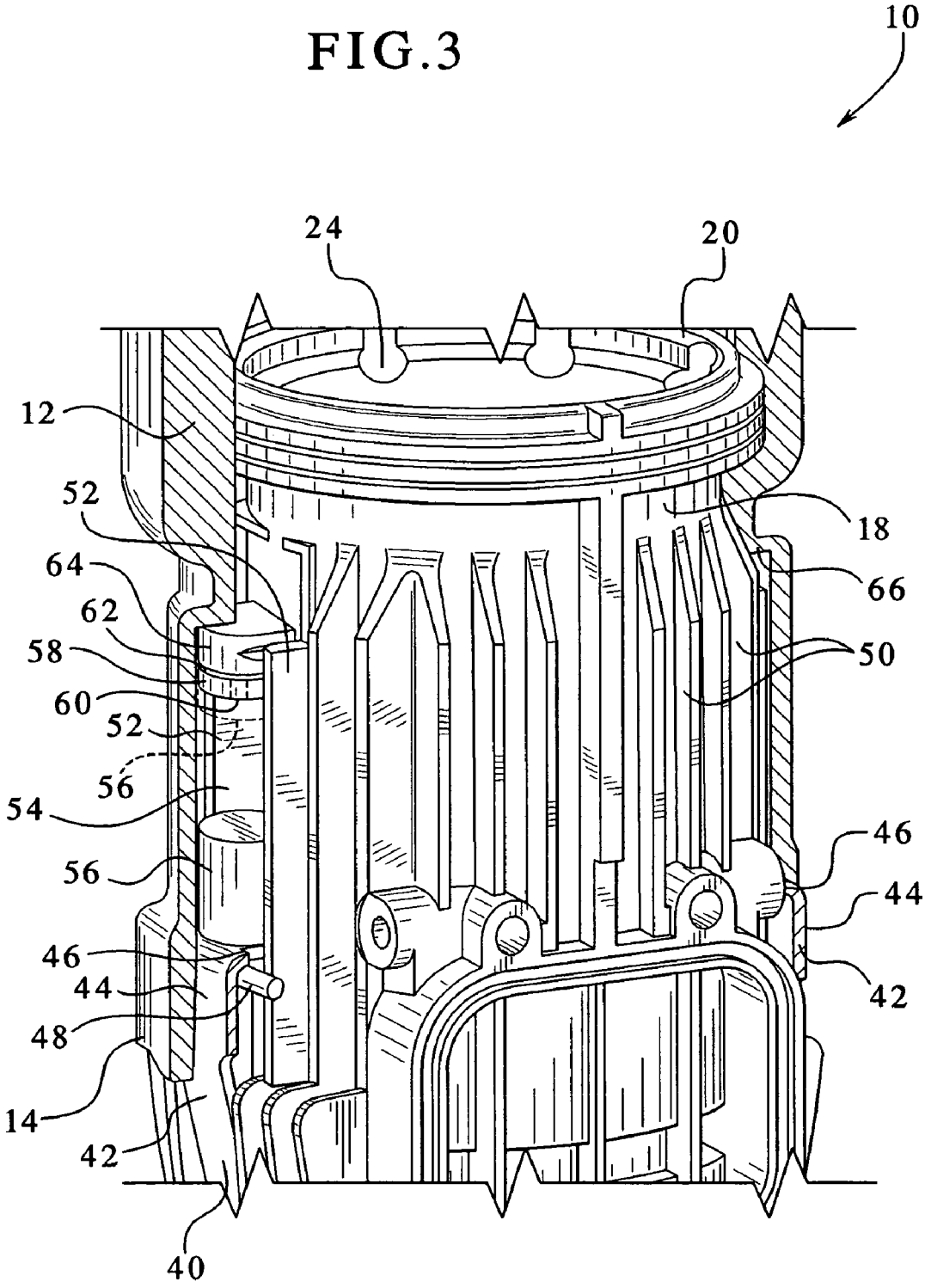
FIG. 3 is a fragmentary perspective view of the relative disposition and connection of the components of the present shock-absorbing system with the valve sleeve in the closed position and tool in the rest position.

A reciprocating probe assembly 26 is slidably disposed relative to the cylinder body 18 and is configured for contacting a workpiece (not shown) and subsequently closing the combustion chamber 24 by moving the valve sleeve 12 between a first, extended or rest position (FIG. 2) and a second or retracted position (FIG. 3). In the former, the combustion chamber 24 is open, and in the latter, the chamber is closed prior to combustion.

Included in the probe assembly 26 is a workpiece contact element 28 with a first end 30 configured for engaging the workpiece and a second end 32 connected to a depth of drive mechanism 34 which adjusts the position of the workpiece contact element 28 relative to a fixed nosepiece 36 as is known in the art. The depth of drive mechanism 34 is associated with an intermediate element 38 of an upper probe 40 which includes the intermediate element and a pair of arms 42 extending vertically from the intermediate element generally parallel to the longitudinal axis of the cylinder body 18. Each arm 42 is associated with a corresponding side of the cylinder body 18.

In the preferred embodiment, at upper ends 44 of each of the arms 42, an angled seat or lip 46 is formed by bending the end laterally, preferably at an approximate right angle. The amount of inclination may vary to suit the application. The seat 46 also engages a link pin 48 which connects each of the arms 42 to a corresponding part of the lower end 14 of the valve sleeve 12. Thus, the valve sleeve 12 moves relative to the cylinder body 18 with the probe assembly 26 generally parallel to the longitudinal axis of the cylinder body.

Referring now to FIGS. 2 and 3, an exterior of the cylinder body 18 is provided with a plurality of cooling fins 50 which in the preferred embodiment are integrally formed with the cylinder head. However, other fastening techniques are contemplated. A pair of adjacent fins 52 on each side of the cylinder body 18 defines a track 54 which generally parallels the longitudinal axis of the cylinder body. It will be seen that the angled seat 46 reciprocates in the track 54 as the probe assembly 26 moves relative to the cylinder body 18.

An important feature of the present combustion assembly 10 is that at least one shock-absorbing element 56 is located between the cylinder body 18 and an upper portion of probe assembly 26, preferably the angled seat 46. In the preferred embodiment, the at least one shock-absorbing element 56 is generally cylindrical in shape, however other shapes are contemplated depending on the application. Further, the shock-absorbing element 56 is configured to generally complement the track 54. In the preferred embodiment this means a generally cylindrical element is engaged in a generally concave track, however other shapes are contemplated, including tongue-in-groove construction.

It is also preferred that the shock-absorbing member 56 is freely slidable in the track 54. However, it is also contemplated that the member 56 may be secured as by adhesive, Vulcanization, or other similar technology to the angled lip 46. Either way, the shock-absorbing member 56 is configured for common travel with the probe assembly 26 in the track 54.

An upper end of the track 54 is defined by an element of the cylinder body 18 referred to as a tab 58, preferably integrally formed with the cylinder body 18, or attached by suitable techniques such as adhesive, welding, etc. The position of the tab 58 in the track 54 and relative to the angled seat 46 may vary to suit the application.

Each of the preferably two shock-absorbing members 56 (one associated with each of the arms 42) is configured for reducing load forces generated in the combustion chamber 24 upon the probe assembly 26 reaching the second position (FIG. 3), and is configured to have sufficient rigidity to limit the travel of the probe assembly 26 relative to the cylinder body 18 and to also have sufficient resilience for absorbing shock forces generated by the tool in the second position, once combustion occurs. The shock-absorbing member 56 is preferably made of a resilient rubber-like material, and it is contemplated that the Shore hardness of the material may vary to suit the application, such as the power level of the tool in which the combustion chamber assembly 10 is mounted.

As is seen in FIG. 3, in the retracted or closed combustion chamber position, the shock-absorbing member 56 prevents further upward travel of the arm 42 toward the tab 58, but has sufficient residual resiliency for absorbing combustion-induced shock loads transmitted by the arms 42 to the cylinder body 18 through the tabs 58. In prior art combustion tools, it was known for such loads to cause premature failure of tool components.

In the present assembly, it is also contemplated for the shock-absorbing member 56 to be secured to an underside 60 of the tab 58. On an upper side 62 of the tab 58, a resilient stop block 64 is preferably affixed. The purpose of the stop block 64 is to dampen shock loads generated by the impact of a shoulder 66 of the valve sleeve 12 impacting the tab 58 when the combustion chamber assembly 10 moves from the retracted position of FIG. 3 to the extended position of FIG. 2. It is also contemplated that the stop block 64 is made of the same resilient material as the shock-absorbing member 56, and even that the two are connected to each other (seen in phantom in FIG. 3). Also, multiple shock-absorbing members 56 are contemplated in each track 54. For example, a first member 56 associated with the angled seat 46 and a second associated with the tab 58.

Referring again to FIG. 1, the cylinder body 18 is preferably provided with a retaining ring 70 associated with, and preferably fixed to the lower end 22 of the cylinder body 18. The retaining ring 70 extends radially from the cylinder body 18. Also, the retaining ring 70 provides a seat for a first end 72 of a spring 74. While conventional combustion chamber assemblies employ two springs for returning, or biasing, the probe assembly 26 to the extended position (FIG. 2), a feature of the present assembly 10 is that the two springs, normally located where the shock-absorbing members 56 are disposed, are eliminated and replaced by the single spring 74. In the preferred embodiment, the spring 74 is a conical spring, with the first end 72 being a relatively wider end mounted to the retaining ring 70, and a second end 76 being relatively narrower or smaller diameter, and being disposed against, or mounted to a stop 80 located on the intermediate element 38. Preferably, the second end 76 is disposed against a portion of the depth of drive adjustment mechanism 34.

It has been found that by replacing the springs with the shock-absorbing member 56, and employing the single spring 74 as disclosed, the shock loading on the lower end of the cylinder body 18 and the associated components is reduced approximately sevenfold.

After the tool fires, high forces are applied through the probe assembly 26. In the preferred embodiment, the probe assembly 26 is stopped and the stress forces dampened by the shock-absorbing member 56 acting in compression between the arms 42 and the associated tabs 58. However, it is contemplated that combustion chamber assembly 10 can be configured to suit the application. It is contemplated that the combustion chamber assembly 10 can be configured with a spring or elastic polymer shock-absorbing member 56 that exerts a biasing force on the upper surface 62 and as such pulls on the cylinder body tab 58 and the probe assembly 26 instead of compressing the shock-absorbing member 56.

It will thus be seen that the present combustion chamber assembly 10, with the shock-absorbing system including the at least one shock-absorbing member 56 and the single return spring 74 provides for a way to easily and cost-effectively move the impact forces of the probe assembly 26 from a lower part of the tool to a more secure part of the tool and dampen the stress forces at the point of contact. It has been found that the implementation of the present system extends combustion tool operational life, especially in tools having greater combustion power.

While particular embodiments of the present combustion chamber assembly have been shown and described, it will be appreciated by those skilled in the art that changes and modifications may be made thereto without departing from the invention in its broader aspects and as set forth in the following claims.

What is claimed is:

1. A combustion chamber assembly for use in a combustion-powered fastener driving tool, comprising:

a cylinder body;

a reciprocating probe assembly slidably disposed relative to said cylinder body between a first, extended position and a second, retracted position, said probe assembly configured for contacting a workpiece; and at least one shock-absorbing member operationally associated with at least one of said cylinder body and said probe assembly for reducing shock load generated by said tool during combustion and transmitted between said probe assembly and said cylinder body;

said probe assembly includes an upper probe including at least one arm portion configured for sliding relationship relative to said cylinder body and having an upper end, said at least one shock-absorbing member disposed between said upper end and a corresponding element of said cylinder body for transmitting loads from said probe assembly to said cylinder body;

wherein said at least one shock-absorbing member is configured for reducing load forces generated in a combustion chamber of said assembly upon said probe assembly reaching said second position, and being configured to have sufficient rigidity to limit the travel of said probe assembly relative to said cylinder body and also sufficient resilience for absorbing shock forces generated by the tool in said second position.

2. The assembly of claim 1, wherein said upper probe includes a substantially perpendicular lip at said upper end for contacting said at least one shock-absorbing element.

3. The assembly of claim 1 wherein said cylinder body defines a track for the slidable relative movement of said probe assembly, and said at least one shock-absorbing member is configured for slidable movement in said track.

4. The assembly of claim 3 wherein said cylinder body includes at least one tab for defining an upper limit of movement of said probe assembly.

5. The assembly of claim 4 wherein said at least one shock-absorbing member is configured for common travel with said probe assembly to said tab.

6. The assembly of claim 3 wherein said at least one shock-absorbing member is freely slidable in said track.

7. The assembly of claim 6 wherein said at least one shock-absorbing member is configured to be substantially complementary with said path.

8. The assembly of claim 4 wherein said at least one shock-absorbing member is secured to one of said probe assembly and said tab.

9. The assembly of claim 5 wherein said at least one shock-absorbing member includes a first portion secured to said probe assembly and a second portion secured to said tab.

10. The assembly of claim 1, wherein said at least one shock-absorbing member is generally cylindrical in shape.

11. The assembly of claim 1 wherein said probe assembly further includes a lower end, and wherein a single spring is located between said lower end of said probe assembly and a retaining ring, configured for biasing said probe assembly into the first position.

12. The assembly of claim 11, wherein said probe assembly is biased into said first position by a single conical spring associated with said probe assembly.

13. The assembly of claim 11, wherein one end of said spring is seated on said retaining ring.

14. The combustion chamber assembly of claim 13, wherein a larger diameter end of said spring is mounted to said retaining ring and a smaller diameter end of said spring is mounted to said lower end of said probe assembly.

15. A combustion chamber assembly for use in a combustion-powered fastener driving tool, comprising:

a cylinder body;

a reciprocating probe assembly slidably disposed relative to said cylinder body between a first, extended position and a second, retracted position, said probe assembly configured for contacting a workpiece; and at least one shock-absorbing member operationally associated with at least one of said cylinder body and said probe assembly for reducing shock load generated by said tool during combustion and transmitted between said probe assembly and said cylinder body;

said probe assembly includes an upper probe including at least one arm portion configured for sliding relationship relative to said cylinder body and having an upper end, said at least one shock-absorbing member disposed between said upper end and a corresponding element of said cylinder body for transmitting loads from said probe assembly to said cylinder body; and said probe assembly further includes a lower end, and wherein a single spring is located between said lower end of said probe assembly and a retaining ring, configured for biasing said probe assembly into the first position.

16. The assembly of claim 15, wherein said single spring is a conical spring.

17. The assembly of claim 15, wherein a larger diameter end of said spring is mounted to said retaining ring and a smaller diameter end of said spring is mounted to said probe assembly.

* * * * *